US008827324B2

(12) United States Patent
Furgiuele

(10) Patent No.: US 8,827,324 B2
(45) Date of Patent: Sep. 9, 2014

(54) MULTI-POINT LOCK ASSEMBLY

(75) Inventor: Robert Furgiuele, Toronto (CA)

(73) Assignee: Roto Fasco Canada Inc. (CA)

( * ) Notice: Subject to any disclaimer, the term of this patent is extended or adjusted under 35 U.S.C. 154(b) by 65 days.

(21) Appl. No.: 13/295,265

(22) Filed: Nov. 14, 2011

(65) Prior Publication Data

US 2013/0119678 A1 May 16, 2013

(51) Int. Cl.

| | |
|---|---|
| ***E05B 65/08*** | (2006.01) |
| ***E05C 1/16*** | (2006.01) |
| ***E05C 21/00*** | (2006.01) |
| ***E05B 63/20*** | (2006.01) |
| *E05C 9/04* | (2006.01) |
| *E05B 15/04* | (2006.01) |

(52) U.S. Cl.

CPC ..... *E05B 63/20* (2013.01); *E05B 65/087* (2013.01); *E05C 9/041* (2013.01); *E05C 9/046* (2013.01); *E05B 2015/0458* (2013.01); *E05B 2015/0486* (2013.01)

USPC ..... 292/137

(58) Field of Classification Search

CPC ..... E05B 2015/0458; E05B 2015/0486; E05B 63/20

USPC ..... 292/137, 142, 160, 177, DIG. 46

See application file for complete search history.

(56) References Cited

U.S. PATENT DOCUMENTS

| | | | | |
|---|---|---|---|---|
| 2,750,221 | A * | 6/1956 | McClelland | 292/341.18 |
| 4,132,438 | A | 1/1979 | Guymer | |
| 4,643,005 | A | 2/1987 | Logas | |
| 5,664,813 | A * | 9/1997 | Gromotka | 292/229 |
| 5,722,704 | A | 3/1998 | Chaput et al. | |
| 5,820,170 | A | 10/1998 | Clancy | |
| 6,264,252 | B1 | 7/2001 | Clancy | |
| 6,606,889 | B1 * | 8/2003 | Tweedy | 70/208 |
| 6,672,632 | B1 | 1/2004 | Speed et al. | |
| 7,040,671 | B2 * | 5/2006 | Liu | 292/24 |
| 7,418,845 | B2 * | 9/2008 | Timothy | 70/100 |

(Continued)

FOREIGN PATENT DOCUMENTS

| | | |
|---|---|---|
| FR | 2342390 A1 | 9/1977 |
| GB | 2212849 A | 8/1989 |
| WO | 9625576 A1 | 8/1996 |

*Primary Examiner* — Kristina Fulton
*Assistant Examiner* — Thomas Neubauer
(74) *Attorney, Agent, or Firm* — Lerner, David, Littenberg, Krumholz & Mentlik, LLP

(57) ABSTRACT

A multi-point lock assembly includes a pair of spaced apart latching members for locking sliding doors, windows or other similar structures. The lock assembly includes a housing rotationally supporting a pair of actuators provided with a plurality of gears arranged in meshed engagement with one another. Rotation of one actuator causes rotation of both actuators in opposite directions, that is, one clockwise and one counterclockwise. Short and long arm assemblies are respectively pivotably connected at their proximal ends to an extended portion of the actuators. The distal end of each arm assembly is guided by a pin received within a track provided in the sidewalls of the housing. The latching members are formed as threaded bolts received within the distal end of each arm assembly. As the actuators are rotated, the distal end of the long and short arm assemblies track along the track within the sidewalls. The shape of the track causes each of the bolts to be displaced vertically and longitudinally along the longitudinal axis of the housing from an unlatched position within the housing to a latched position extending outwardly therefrom. The bolts are adjustable by varying their threaded engagement within the distal ends of the arm assemblies for alignment with the opposing keeper.

27 Claims, 12 Drawing Sheets

(56) References Cited

U.S. PATENT DOCUMENTS 7,559,584 B2 * 7/2009 Rebel et al. ..... 292/25
2006/0071478 A1 * 4/2006 Denys ..... 292/26
2008/0265587 A1 * 10/2008 Nakanishi et al. ..... 292/26
2009/0134634 A1 * 5/2009 Atkinson et al. ..... 292/26

* cited by examiner

MULTI-POINT LOCK ASSEMBLY

BACKGROUND OF THE INVENTION

The present invention relates generally to the field of locks, and more particularly, to multi-point lock assemblies for sliding doors and windows, or similar structures.

In a typical sliding door installation, a door latch having one or more latching members is mounted into the stile of a movable door. A keeper is typically mounted into an opposing stationary door jam. The door is closed by bringing the stile into contact with the door jam, and then, locked by rotating a door locking lever to cause the latching members to extend and engage aligned corresponding openings in the opposing keeper. To enhance the strength of the locking relationship between the door and the keeper, multiple latching members are preferably used in the door latch, hence the term multi-point lock. Multi-point locks of this type provide increased security against forced entry.

Examples of multi-point locks are disclosed in U.S. Pat. No. 6,672,632 and U.S. Patent Publication No. 2009/0134634, the disclosures of which are incorporated herein by reference. In U.S. Pat. No. 5,820,170 there is disclosed a multi-point door latch incorporating a pair of opposing hooks pivotably mounted to an adjustment assembly. The adjustment assembly is operative to displace the pivot axis of each hook within the lock's housing to enable adjustment of the hooks, forwardly and rearwardly, for engagement with an opposing keeper.

BRIEF SUMMARY OF THE INVENTION

The present invention describes and illustrates a multi-point door latch suitable for use with various closures such as sliding doors and windows to be securely closed and locked. By way of illustration, the multi-point lock is especially suitable for use with sliding doors that open to an outside area where restricted passage is desired.

In accordance with one embodiment, there is described a multi-point lock assembly adapted for releasable engagement with a keeper, the lock assembly comprising a housing; a pair of actuators rotatably supported within the housing whereby rotation of one actuator causes rotation of the other actuator; a first latching member coupled to one actuator and a second latching member coupled to the other actuator; and at least one track formed within the housing in operative association with the first and second latching members, wherein rotation of one of the actuators causes at least one of the first and second latching members to be displaced along the at least one track between a non-latching position and a latching position.

In accordance with another embodiment of the present invention, there is described a multi-point lock assembly adapted for releasable engagement with a keeper, the lock assembly comprising a housing; first and second meshed actuators rotatably supported within the housing, whereby rotation of the first actuator causes rotation of the second actuator; a first arm assembly pivotally coupled to the first actuator; a second arm assembly pivotally coupled to the second actuator; a first latching member coupled to the first arm assembly having a first portion adapted for releasable engagement with a keeper; a second latching member coupled to the second arm assembly having a first portion adapted for releasable engagement with a keeper; and wherein rotation of the first or second actuator causes displacement of the first and second latching members longitudinally within the housing between non-latching and latching positions, wherein the first and second portions of the latching members engage the keeper when in the latching position.

In accordance with still another embodiment of the present invention, there is described a multi-point door lock assembly for releasable engagement with a keeper, the lock assembly comprising an elongated hollow housing; first and second meshed actuators rotatably supported within the housing, wherein rotation of at least one of the first and second actuators in one direction causes rotation of the other actuator in an opposite direction; a first arm assembly having a first end and a second end, the first end of the first arm assembly pivotably coupled to the first actuator; a second arm assembly having a first end and a second end, the first end of the second arm assembly pivotably coupled to the second actuator; a first bolt having an enlarged end and an opposite threaded end threadingly coupled to the second end of the first arm assembly; a second bolt having an enlarged end and an opposite threaded end threadingly coupled to the second end of the second arm assembly; a first track within the housing coupled to the second end of the first arm assembly; a second track within the housing coupled to the second end of the second arm assembly; and hereby rotation of at least one of the first or second actuators causes the first and second bolts to be displaced in a longitudinal direction within the housing along the first and second tracks between a non-latching position and a latching position whereby the enlarged end of the first and second bolts releasably engage a keeper.

In accordance with still another embodiment of the present invention, there is described a multi-point lock assembly adapted for releasable engagement with a keeper, the lock assembly comprising; a housing; a pair of spaced apart latching members moveable between a non-latching position and a latching position in releasable engagement with a keeper; and an actuator assembly for moving the latching members between the non-latching and latching position; and wherein the latching members have one end moveably coupled to the actuator assembly for adjusting the position of another end of the latching members relative to the actuator assembly.

In accordance with still another embodiment of the present invention, there is described a multi-point lock assembly comprising a housing; an actuator assembly supported within the housing; a first latching member and a second latching member coupled to the actuator assembly; and at least one track formed within the housing in operative association with at least one of the first and second latching members, wherein operation of the actuator assembly causes at least one of the first and second latching members to be displaced along the at least one track between a non-latching position and a latching position.

DETAILED DESCRIPTION

Figure 1:
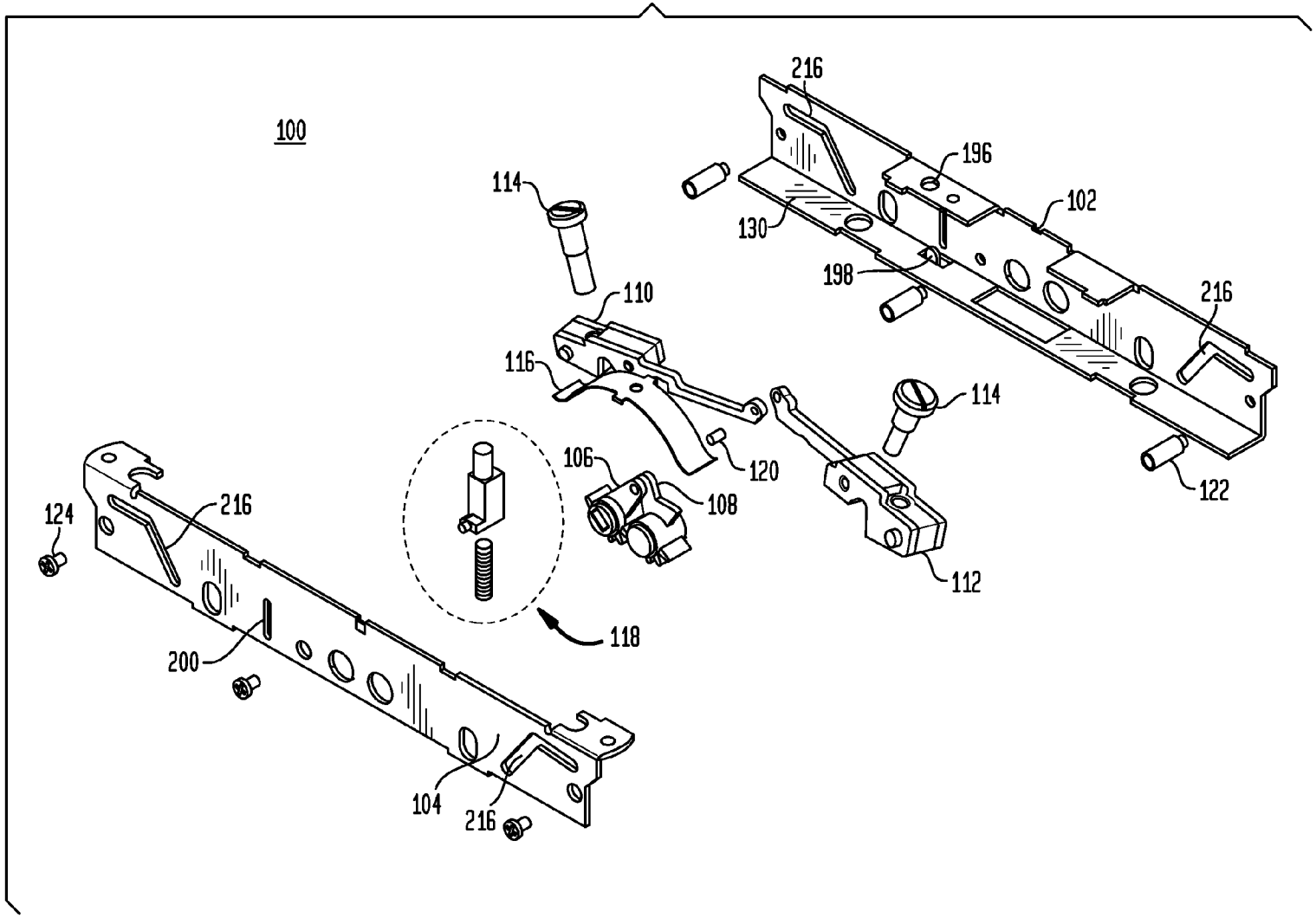
FIG. 1 is an exploded unassembled perspective view of a multi-point lock assembly constructed in accordance with one embodiment of the present invention.

In describing the preferred embodiments of the invention illustrated in the drawings, specific terminology will be used for the sake of clarity. However, the invention is not intended to be limited to the specific terms so used, and it is to be understood that each specific term includes all equivalence that operate in a similar manner to accomplish a similar purpose.

Turning now to the drawings, wherein like reference numerals represent like elements, there is illustrated in FIG. 1 a multi-point lock assembly 100 constructed in accordance with one embodiment of the present invention. The lock assembly 100 is constructed to include, for example, a generally planar back plate 102, a generally planar front plate 104, a first actuator 106, a second actuator 108, a long arm assembly 110, a short arm assembly 112, latching members 114, a spring 116 and an anti-slam plunger assembly 118. The multi-point lock assembly 100 may also include other components as to be described hereinafter. For example, in assembling the lock assembly 100, there may be included a plurality of joint pins 120, support posts 122, and a plurality of screws 124. In addition, a lesser number of components may be included in the lock assembly 100, for example, the anti-slam plunger assembly 118 is an optional assembly and can be deleted from the lock assembly.

Figure 2:
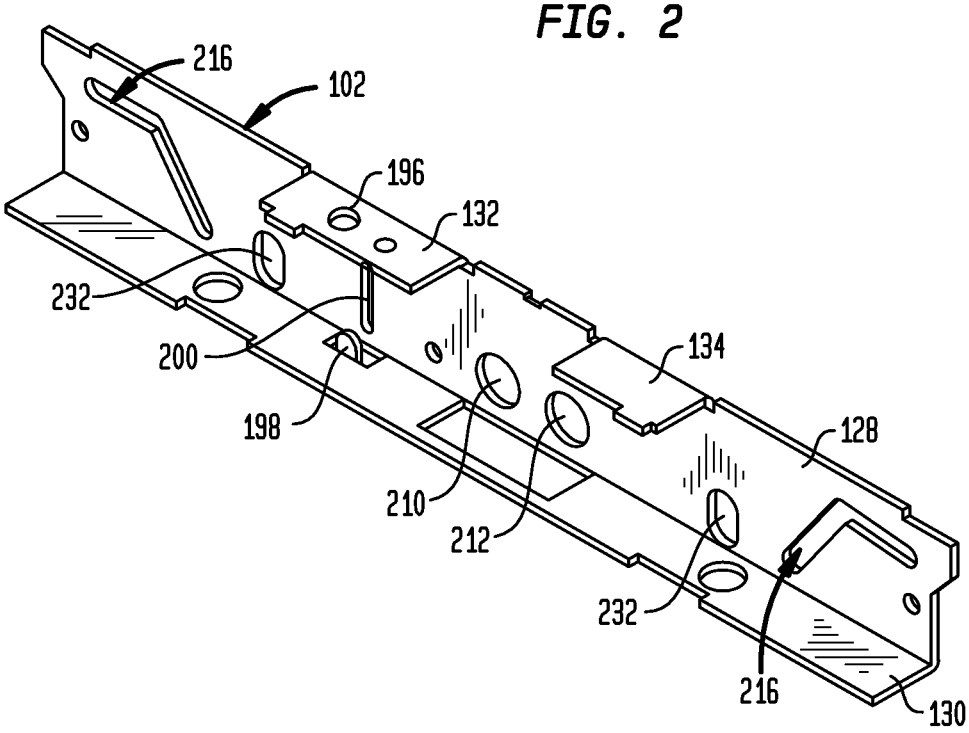
FIG. 2 is a perspective view of a back plate forming a portion of the multi-point lock assembly housing.
Figure 3:
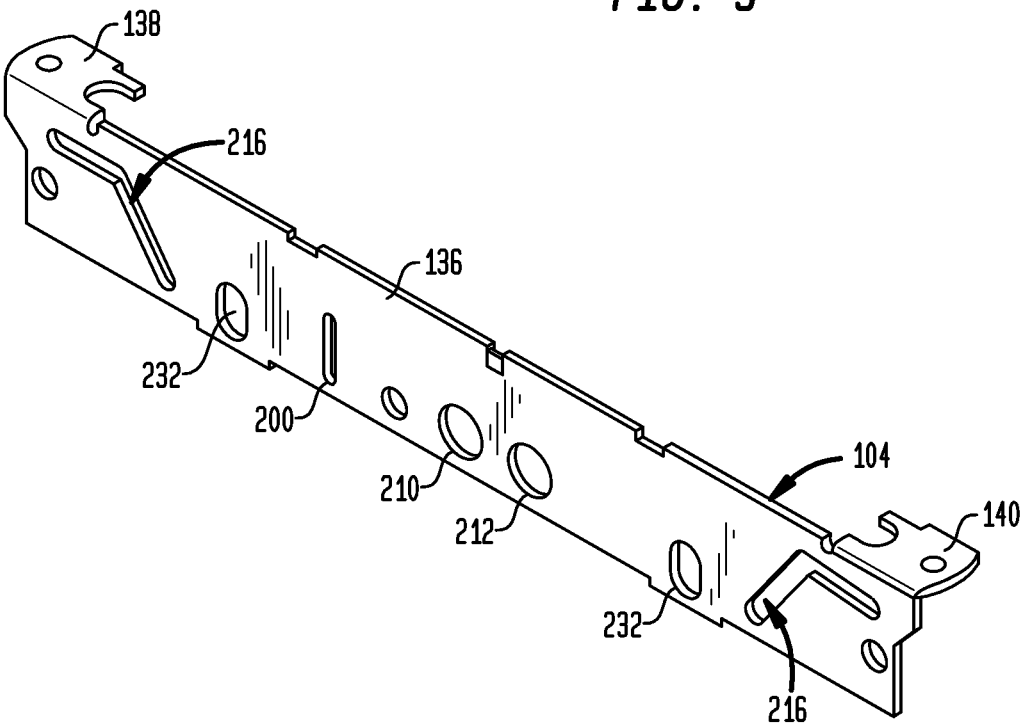
FIG. 3 is a perspective view of a front plate forming a portion of the multi-point lock assembly housing.

The components forming the lock assembly 100 are assembled internally within a housing 126 formed from the back plate 102 and front plate 104 as shown in FIGS. 2 and 3. The back plate 102 includes a back sidewall 128, a bottom wall 130 and a pair of spaced apart top walls 132, 134. The bottom wall 130 is arranged extending generally transverse to the back sidewall 128 along its bottom edge. Likewise, the top walls 132, 134 extend generally transverse to the back sidewall 128 along its top edge. The back plate 102 may be formed, for example, by stamping a piece of sheet metal into the desired form.

In a similar construction, the front plate 104 includes a front sidewall 136 and a pair of spaced apart top walls 138, 140. The top walls 138, 140 are arranged generally transverse to the front sidewall 136 along its top edge at opposite ends thereof. Unlike the back plate 102, the front plate 104 does not include a bottom wall. Like the back plate 102, the front plate 104 can be constructed using a suitable stamping process from sheet metal and the like. The back plate 102 and front plate 104 include a plurality of openings whose shape, arrangement and function will be described hereinafter in conjunction with the assembling of the lock assembly 100 and the operation thereof of the latching members 114 from between a latched orientation and an unlatched orientation.

Figure 4:
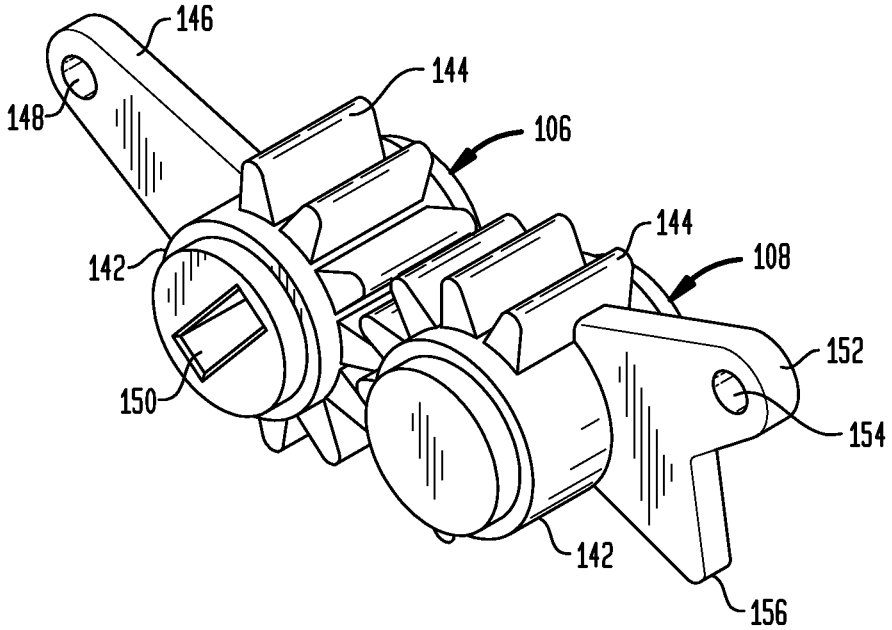
FIG. 4 is a perspective view of a pair of operatively arranged actuators.

FIG. 4 illustrates the construction and operative arrangement of the actuators 106, 108 when in assembled relationship within the lock assembly housing 126. Each of the actuators 106, 108 includes a cylindrical body 142 at least partially circumscribed by a plurality of gears 144 which may be integrally formed therewith. The gears 144 extend approximately 180° around the cylindrical body 142, although a lesser or greater extent is contemplated within the scope of the present invention. Actuator 106 includes an arm 146 extending radially outward from the cylindrical body 142 and having an opening 148 at its terminal end. The cylindrical body 142 incorporates a slotted opening 150 adapted to receive a tail piece (not shown) to be operatively coupled to a handle, thumb knob, or key lock assembly for actuating the lock assembly 100. Actuator 108 similarly includes a projecting arm 152 having an opening 154 at its terminal end, and further, including a laterally extending arm projection 156. As illustrated, the arms 146, 152 are generally planar bodies which may be integrally formed with the bodies 142.

Figure 5:
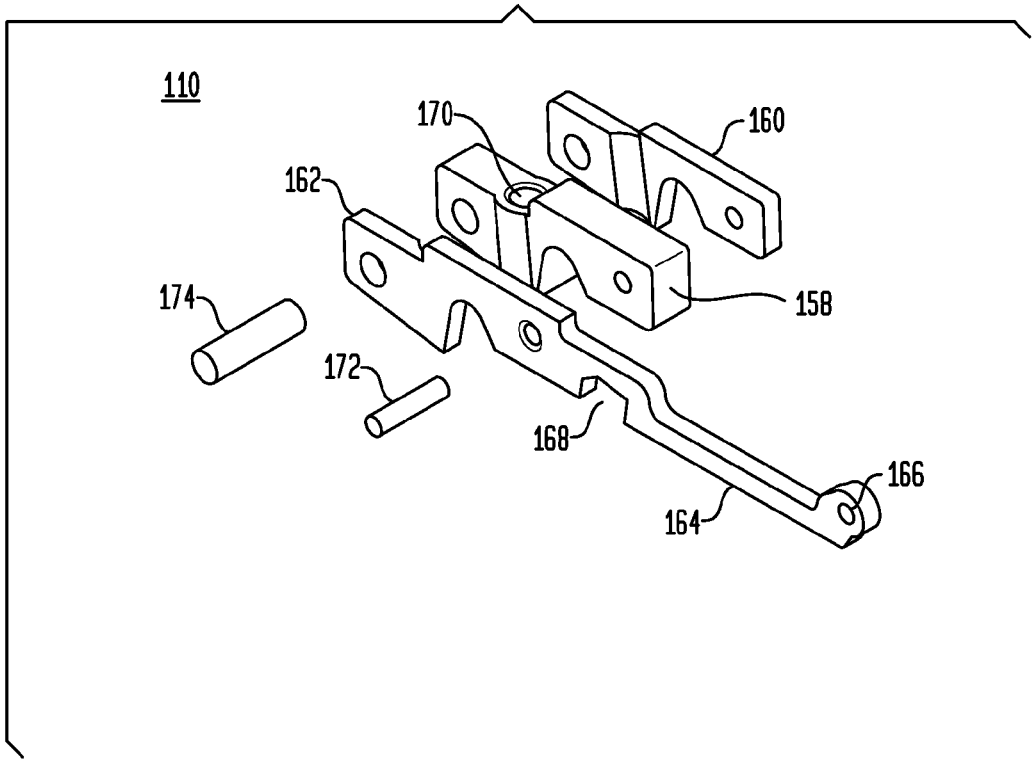
FIG. 5 is a perspective exploded unassembled view of a long arm assembly.
Figure 14:
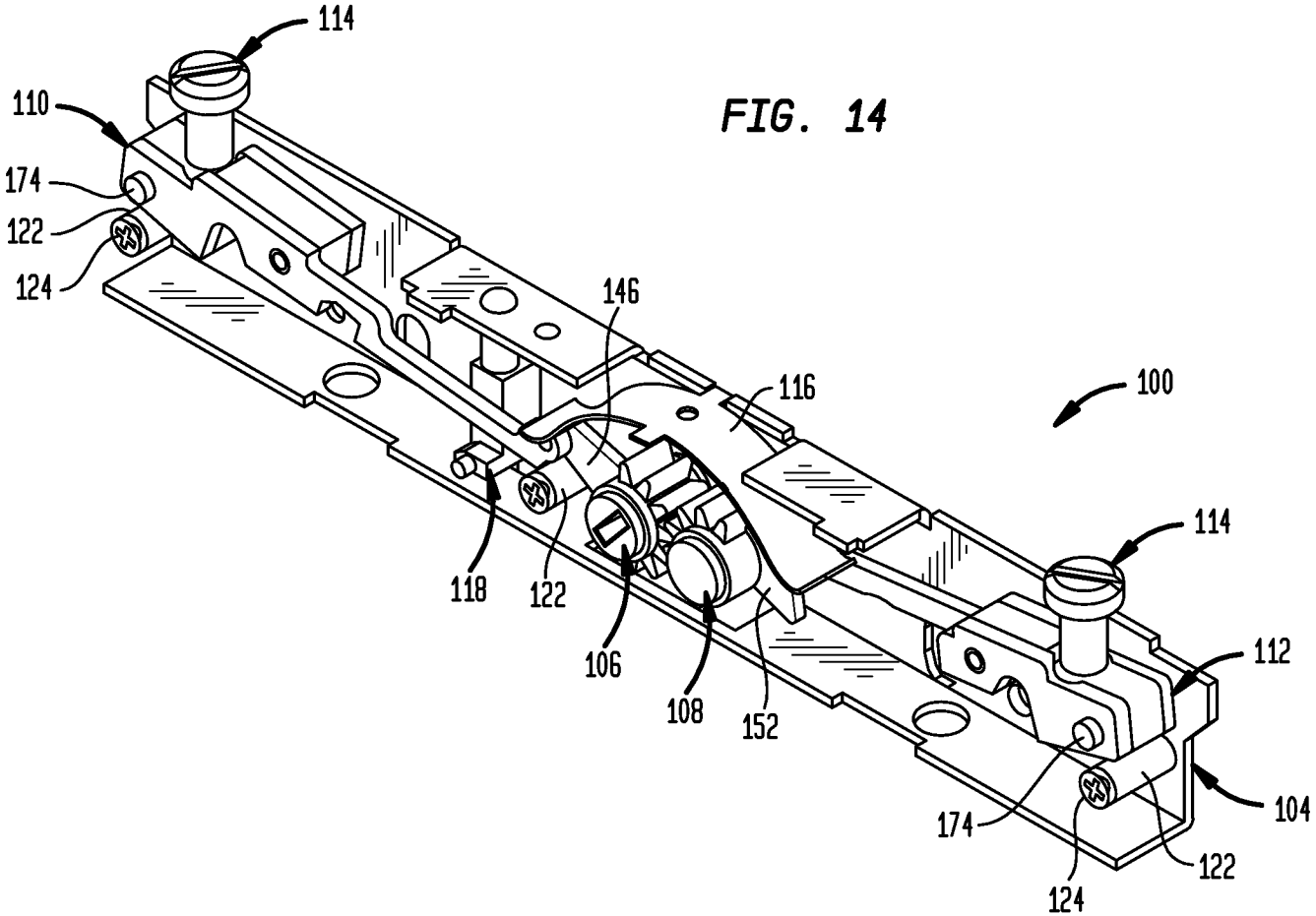
FIG. 14 is a perspective view of the multi-point lock assembly having the front plate removed for illustrating the lock assembly in an assembled relationship.

The long arm assembly 110, as shown in FIG. 5, includes a main body 158 sandwiched between a generally planar short plate 160 and a generally planar long plate 162. The long plate 162 is provided with an elongated extension 164 having an opening 166 at its terminal end. A notch 168 is provided opening downward along a portion of the long plate 162 which is operative with the anti-slam plunger assembly 118 as to be described. The main body 158 is provided with a threaded opening 170 adapted to receive one end of one of the latching members 114 such as shown in FIG. 14.

Figure 6:
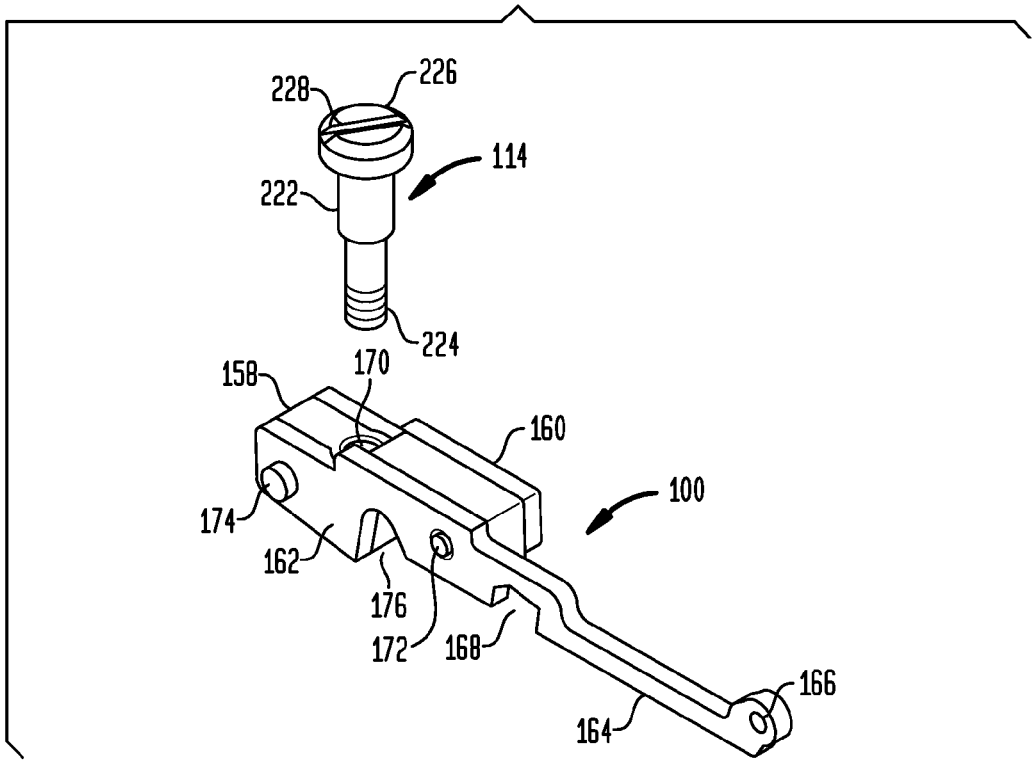
FIG. 6 is a perspective view of the long arm assembly in an assembled relationship.

Referring to FIG. 6, the main body 158 is secured in assembled relationship between the short plate 160 and the long plate 162 by a securing pin 172 and a guide pin 174 extending through aligned openings. The length of the guide pin 174 is greater than the combined width of the assembled long arm 110 such that a portion of the guide pin extends outwardly from the short plate 160 and the long plate 162. The assembled long arm assembly 110 includes a downwardly facing notch 176 to accommodate a pass-through bolt used for securing the lock assembly 100 in the stile of the door.

Figure 7:
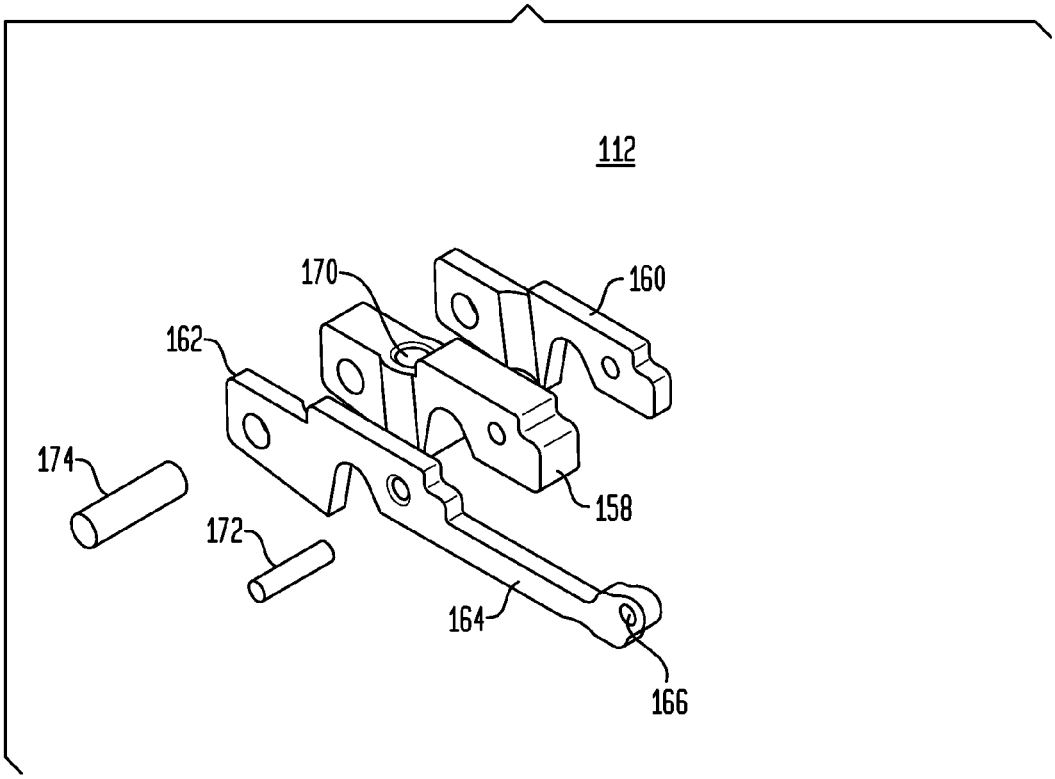
FIG. 7 is a perspective exploded unassembled view of a short arm assembly.
Figure 8:
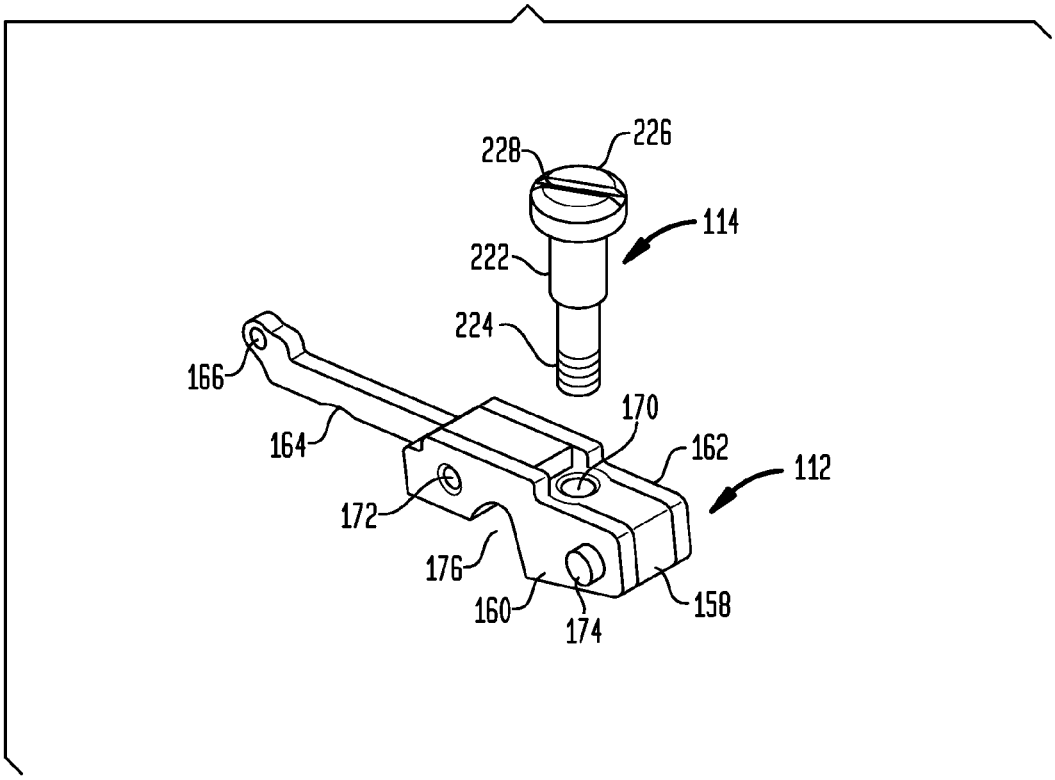
FIG. 8 is a perspective view of the short arm assembly in an assembled relationship.

The short arm assembly 112 is shown in unassembled relationship in FIG. 7, and in assembled relationship in FIG. 8. The short arm assembly 112 is constructed to include components similar to those described with respect to the long arm assembly 110, namely, a main body 158, a generally planar short plate 160 and a generally planar long plate 162 having an extension 164. The main body 158 is provided with a threaded opening 170 adapted to receive one end of the other latching member 114 such as also shown in FIG. 14. The extension 164 of the short arm assembly 112 is shorter in length than the extension in the long arm assembly 110. In addition, the extension 164 of the short arm assembly 112 does not include a notch 168 as the short arm assembly is not arranged in operative relationship with the anti-slam plunger assembly 118. The short arm assembly 112 is assembled as thus far described using securing pin 172 and guide pin 174 extending through aligned openings. Likewise, the assembled short arm assembly 112 includes a downwardly facing notch 176 to accommodate a pass-through bolt used for securing the lock assembly 100 in the stile of a door.

Figure 9:
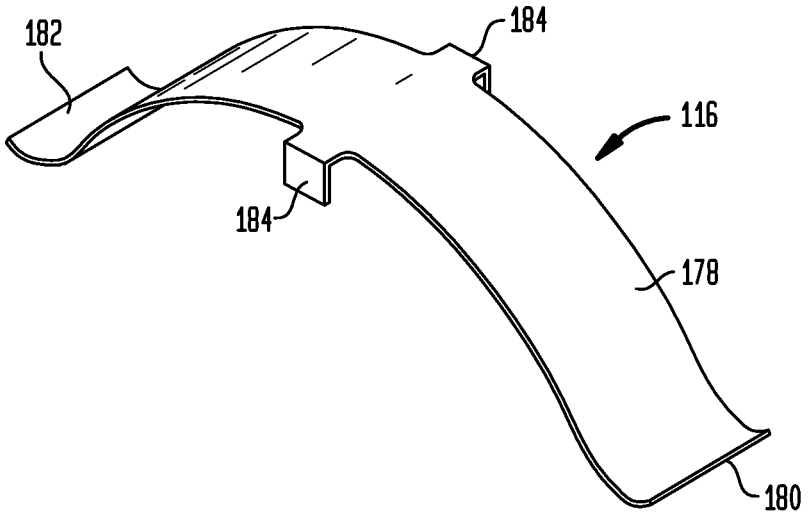
FIG. 9 is a perspective view of a spring.

FIG. 9 illustrates the construction of the biasing spring 116. The spring 116 is generally formed from a planar plate 178 having a curved or bowed shape. The ends of the plate 178 are provided with curved upturned ends 180, 182. The ends 180, 182 have a curvature in the opposite direction to that of the remainder of the plate 178. Centrally located along the plate 178 are a pair of spaced apart downwardly extending tabs 184 provided along the side edges of the plate. The spring 116 may be formed from suitable metal materials known in the art of plate springs. The spring when assembled in the lock assembly 100 is operative for biasing the latching members 114 during operation of the lock assembly.

Figure 11:
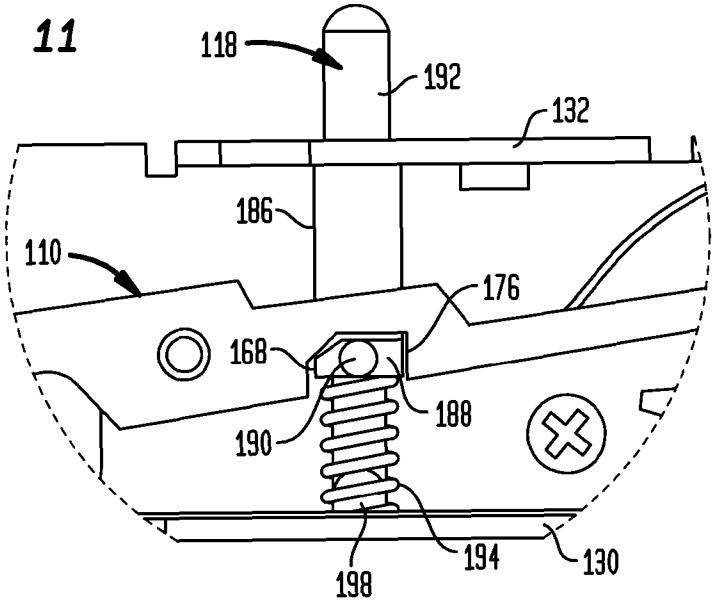
FIG. 11 is an enlarged front elevational view of the anti-slam plunger assembly.
Figure 10:
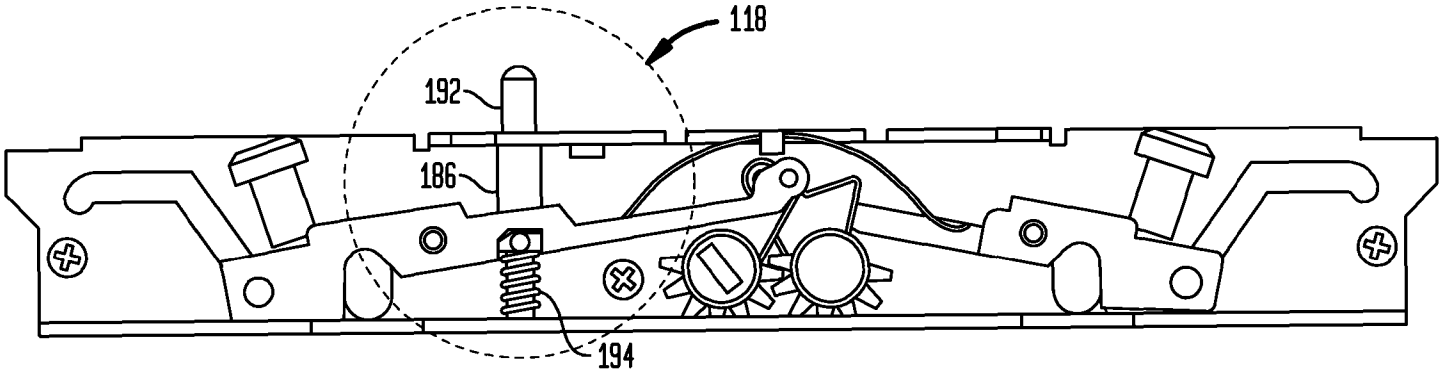
FIG. 10 is a front elevational view showing the multi-point lock assembly in an assembled relationship, including an anti-slam plunger assembly.
Figure 16:
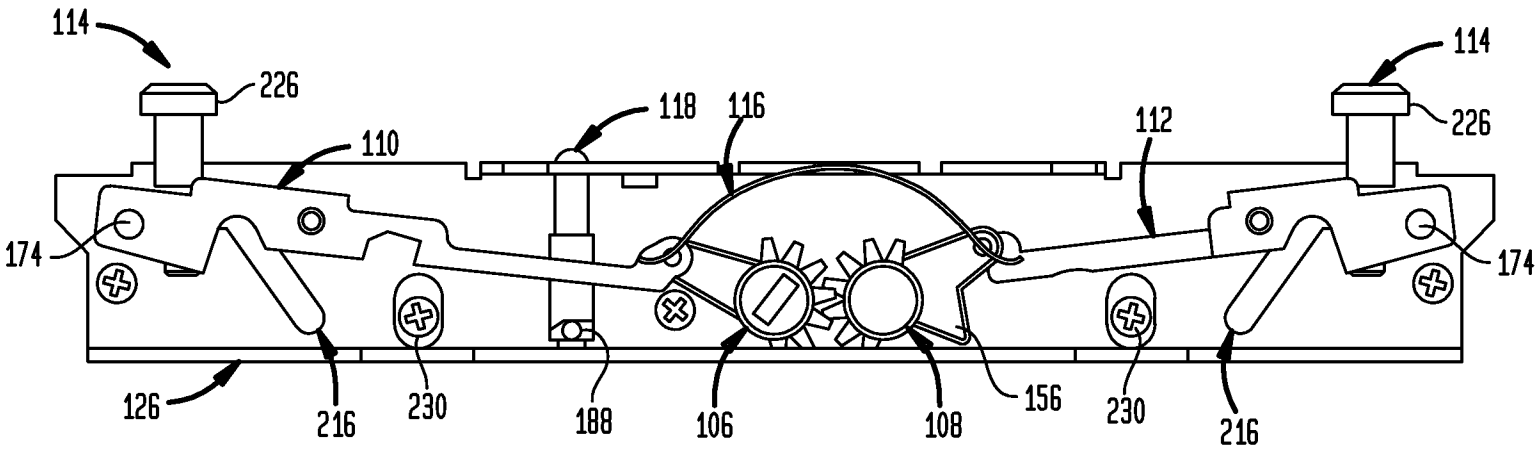
FIG. 16 is a front elevational view illustrating the multi-point lock assembly in a latched orientation.

Referring now to FIGS. 10 and 11, the anti-slam plunger assembly 118 will now be described. The anti-slam plunger assembly is a safety feature optionally included in the lock assembly 100 of the present invention. In particular, there is a potential for damaging the lock assembly if an attempt is made to close the sliding door with the latching members 114 extended outwardly in the latched position, such as shown in FIG. 16. This would result in the latching members 114 forcibly slamming into the opposing keeper which could result in damage to the components of the lock assembly. To prevent this event, the lock assembly 100 can incorporate the anti-slam plunger assembly 118.

The anti-slam plunger assembly 118 includes a main body 186. The lower end of the main body 186 is provided with a laterally extending projection 188 having a pin 190 extending outwardly from opposite sides thereof. A cylindrical plunger 192 extends from the other end of the main body 186. The main body 186 is normally biased upwardly within the housing 126 by a compression spring 194 engaged against the lower end of the main body.

The anti-slam plunger assembly 118 is mounted within the lock assembly 100 between the back plate 102 and front plate 104 overlying the bottom wall 130. The plunger 192 extends upwardly freely through opening 196 in the top wall 132 of the back plate 102. The spring 194 is positioned and secured at its bottom end by projecting tab 198 extending upwardly from the bottom wall 130 of the back plate 102. The pin 190 extending from the projection 188 extends through vertically arranged slotted openings 200 formed in the back sidewall 128 of the back plate 102, see FIG. 14, and in the front sidewall 136 of the front plate 104, see FIG. 13. The slotted openings 200 provide a guide for the vertical reciprocal displacement of the plunger 192 in response to the biasing action of the spring 194. The projection 188 on the lower end of the anti-slam plunger assembly 118 is temporarily received within the notch 168 formed on the long arm assembly 110. The operation of the anti-slam plunger assembly 118 will be described hereinafter.

Figure 12:
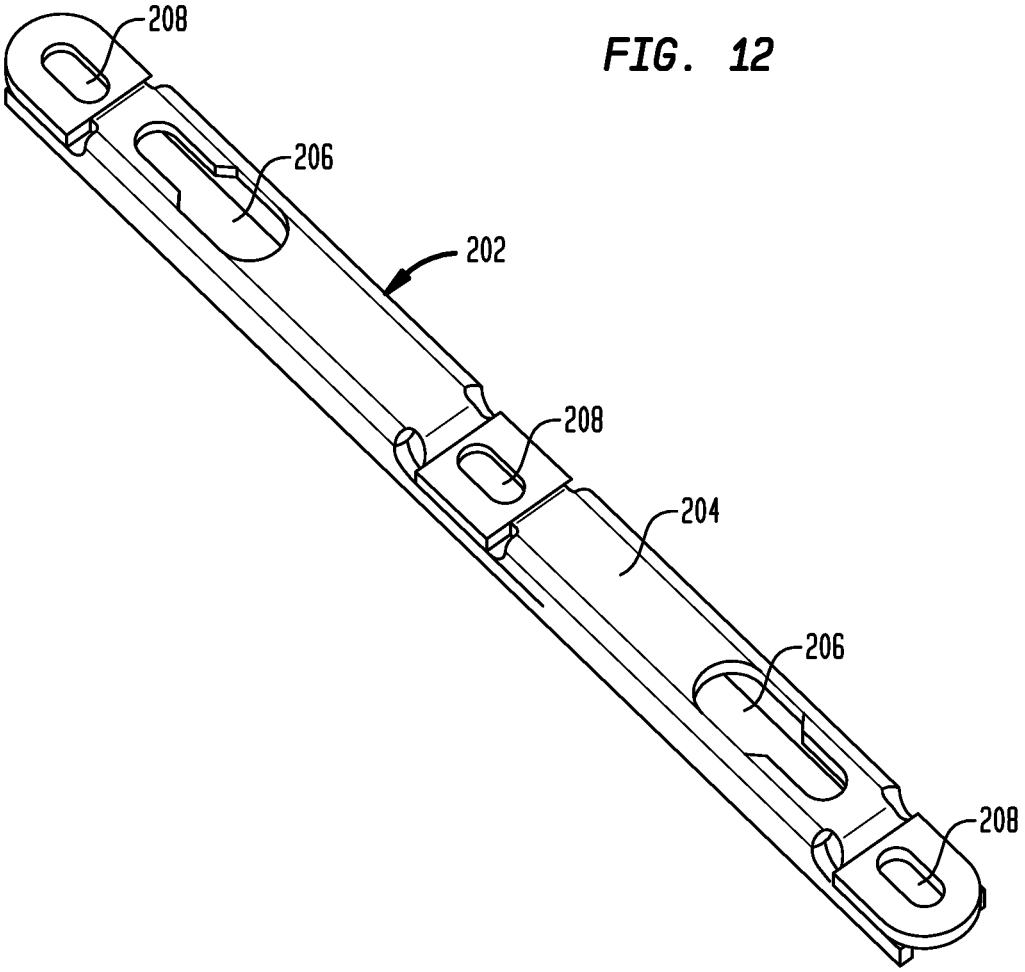
FIG. 12 is a perspective view of a keeper adapted for use with the multi-point lock assembly.

A keeper 202 for the lock assembly 100 is shown in FIG. 12. The keeper 200 is constructed from an elongated body 204 having spaced apart keyhole shaped openings 206 formed to include enlarged and narrow portions. The keeper also includes spaced apart slotted openings 208 adapted to enable securing of the keeper to a door jam by means of suitable fasteners such as screws. The keeper 202 is shown in operative opposing relationship to the lock assembly 100 in FIG. 13. The slotted openings 208 enable the longitudinal displacement of the keeper 202 so as to properly align the keyhole shaped openings 206 with the opposing latching members 114 of the lock assembly 100.

Figure 15:
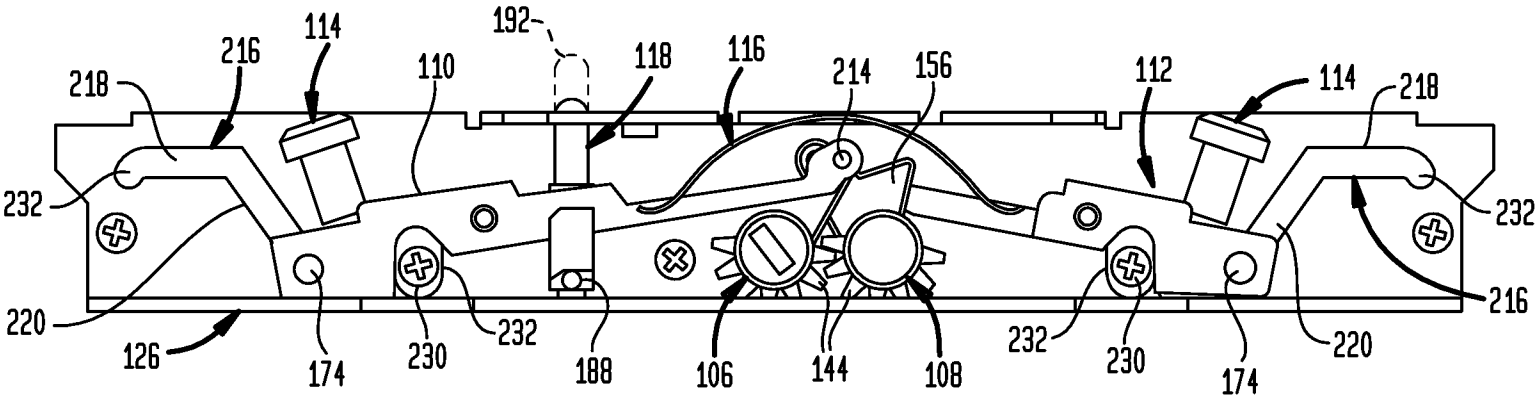
FIG. 15 is a front elevational view illustrating the multi-point lock assembly in an unlatched orientation.

Referring now specifically to FIG. 14, and more generally to FIGS. 15 and 16, there will be described the assembly of the various components constituting the lock assembly 100. The housing 126 is assembled by joining the back plate 102 to the front plate 104 by means of spaced apart support posts 122 and attachment screws 124.

The actuators 106, 108 are rotationally secured within the housing 106 by virtue of the opposite ends of their cylindrical body 142 being rotationally received within aligned openings 210, 212, within the back plate 102 and front plate 104. The actuators 106, 108 are positioned juxtaposed one another such that their respective gears 144 are meshed with each other. According to this arrangement, rotation of actuator 106 via a tail piece (not shown) attached to, for example, a handle, thumb knob or key lock, will effect corresponding rotation of the other actuator 108. As a result, rotation of actuator 106 in a clockwise direction will effect rotation of actuator 108 in a counterclockwise direction, and vice versa.

Figure 13:
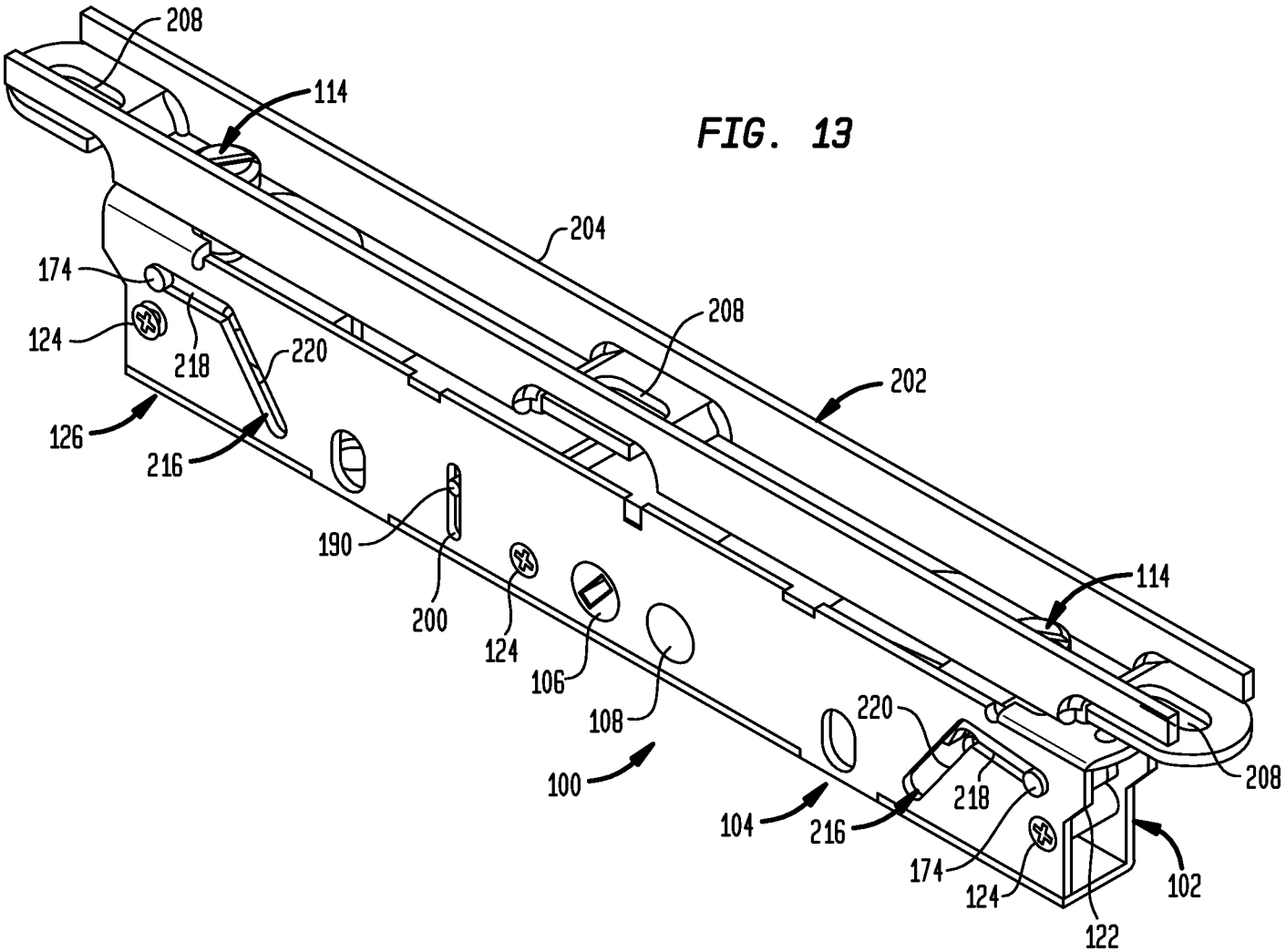
FIG. 13 is a perspective view showing the operative relationship of the keeper with the multi-point lock assembly.

The long arm assembly 110 is pivotably coupled to the arm 146 of actuator 106 by a pin 214 extending through the opening 166 in the actuator extension 164 and opening 148 within the actuator arm. The other end of the long arm assembly 110 is coupled to the back plate 102 and front plate 104 by means of the guide pin 174 having its opposite ends captured within tracks 216 formed within the back plate and front plate. The tracks 216 are formed in the nature of elongated slots having first and second linear portions arranged at an obtuse angle to each other. As best shown in FIG. 13, tracks 216 include a first slot portion 218 extending longitudinally generally along the longitudinal axis of the housing 126 and a second contiguous slot portion 220 arranged at an obtuse angle thereto. As such, rotation of actuator 106 causes the long arm assembly 110 to move within the interior of the housing 126 guided by the track 216.

In a like manner, the short arm assembly 112 is pivotably coupled to the arm 152 of actuator 108. Specifically, a pin 214 extends through the opening 166 in the short arm extension 164 and the opening 154 within the actuator extension 152. The other end of the short arm assembly 112 is guided within the track 216 by means of guide pin 174 in the manner previously described.

The latching members 114, as shown in FIGS. 6 and 8, are constructed in the nature of a bolt as is known in the fastening art. Each of the latching members 114 includes an elongated body 222 having a threaded end 224 and an opposite enlarged head 226. The enlarged head 226 although illustrated as a cylindrical circular member, may be provided in other geometric shapes, such as oval, square, polygonal, and the like. A adjustment slot 228 or other engageable opening is provided within the top of the enlarged head 226. The latching members 114 are threadingly received within the threaded openings 170 within the respective long arm assembly 110 and short arm assembly 112. As shown in FIGS. 15 and 16, the longitudinal axis of the latching members 114 are arranged transverse to the longitudinal axis of the long arm assembly 110 and short arm assembly 112.

The spring 116 is operative for biasing the long arm assembly 110 and short arm assembly 112 between latched and unlatched orientations within the housing 126. As shown in FIG. 14, the spring 116 is arranged within the housing 126 overlying the actuators 106, 108. The upturned ends 180, 182 are positioned resting on the extensions 164 of the long arm assembly 110 and short arm assembly 112 such as shown in FIG. 15. The spring 116 is maintained in proper position within the housing 126 by means of the tabs 184 being received within openings within the back plate 102 and front plate 104.

The lock assembly 110 is secured within an opening within the stile of a moveable door or the like. In this regard, screws (now shown) are inserted into the door stile through the openings in the top walls 138, 140 of the front plate 104. Bolts 230 are arranged extending transversely through the door so as to pass through the housing 126 and through openings 232 within the back plate 102 and front plate 104, see FIG. 15. The notches 176 within the long arm assembly 110 and short arm assembly 112 prevent interference with the bolts 230. This arrangement provides enhanced security by minimizing the ability to remove the lock assembly 100 from a closed door when locked.

The operation of the lock assembly 100 will now be described. In the unlatched position as shown in FIG. 15, the long arm assembly 110 and short arm assembly 112 are pulled inwardly towards each other by their respective actuators 106, 108. The spring 116 biases the long arm assembly 110 and short arm assembly 112 downwardly with their guide pins 174 being positioned at the lower end of the respective tracks 216 within the back plate 102 and front plate 104. The latching members 114 are arranged internally within the confines of the housing 126 and out of engagement with the keeper 202.

Before closing the sliding door against the opposing door jam or keeper, the plunger 192 of the anti-slam plunger assembly 118 extends outwardly by operation of spring 194 as shown in FIG. 11. In this arrangement, the projection 188 is received within the notch 176 in the long arm assembly 110. This prevents manipulation of the latching members 114 by means of the actuators 106, 108 from the unlatched position shown in FIG. 15 to the latched position as shown in FIG. 16. As the door or other closure is closed, the opposing surface of the door jam or keeper engages the plunger 192 forcing the main body 186 downwardly within the housing 126 whereby the projection 188 is released from the notch 176 within the long arm assembly 110. Reciprocal movement of the anti-slam plunger assembly 118 is guided by the pin 190 projecting into the aligned slotted openings 200 in the back plate 102 and front plate 104.

With the anti-slam plunger assembly 118 now disengaged, the lock assembly 100 may be manipulated into a latched position such as shown in FIG. 16. Actuator 106 is rotated via the tail piece (not shown) in a counterclockwise direction which effects clockwise rotation of actuator 108 by virtue of the mesh gears 144. As the actuators 106, 108 rotate, the latching members 114 are guided from the unlatched position to the latched position along tracks 216 by the long arm assembly 110 and short arm assembly 112. The latching members 114 move linearly from within the housing 126 to a latched orientation extending outwardly from the housing as the long arm assembly 110 and the short arm assembly 112 follow the linear portions 216, 218 of the track 216. The shape of the track 216 causes each of the latching members 114 to be displaced both vertically and longitudinally relative to the longitudinal axis of the housing The latching members 114 are maintained in their latched positions by, in part, biasing of spring 116, which maintains the pins 174 of the long arm assembly 110 and short arm assembly 112 positioned in a downward dip 232 at the end of the tracks 216. Over rotation of the actuators 106, 108 is generally prevented by the arm projection 156 on the actuator 108 engageable with the bottom wall of the housing 126 if over rotated.

As the latching members 114 are displaced outwardly, they are initially received within the larger portion of the keyhole shaped opening 206 of the keeper 202. As the latching members 114 are further displaced longitudinally, the latching members are received within the narrow restricted portion of the keyhole shaped opening 206. As the head 226 of the latching members 114 is larger than the narrow portion of the keyhole shaped opening 206, opening of the door or other closure is precluded.

Clearance between the head 226 of the latching members 114 and the keeper 202 is adjustable to ensure positive door closure. In this regard, each of the latching members 114 is threadably received within their corresponding long arm assembly 110 or short arm assembly 112. The latching members 114 may be advanced outwardly or inwardly by rotating the latching members to either increase or decrease their threaded engagement with the threaded openings 170 within the long and short arm assemblies. Rotation of the latching members 114 can be accomplished, by way of example, using a suitable tool such as a screwdriver engaged within the adjustment slot 228 or other shaped opening. In addition, the shape of the head 226 of the latching members 114 may be polygonal or other shape whereby a suitable wrench may be used for adjustment.

The lock assembly 100 may be unlocked in a reversed procedure to that of locking the lock assembly as thus far described. Specifically, the actuator 106 will be rotated in a clockwise direction which will effect counterclockwise rotation of actuator 108. Rotation of the actuators 106, 108 will cause the long arm assembly 110 and short arm assembly 112 to be drawn inwardly towards each other while following along their respective tracks 216 by virtue of engaged guide pins 174. As a result, the latching members 114 will be withdrawn from the keyhole shaped openings 206 within the keeper 202 and retracted into the interior of the housing 126 as shown in FIG. 15. The lock assembly 100 of the present invention enables the latching and unlatching of the assembly for securing a sliding door, window or other closure structure in a simple and efficient manner.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A multi-point lock assembly adapted for releasable engagement with a keeper, the lock assembly comprising:

a housing having spaced apart sidewalls and first and second spaced apart housing ends;

a pair of actuators rotatably supported within the housing between the first and second housing ends, whereby rotation of one actuator causes rotation of the other actuator;

a first arm assembly having a first end pivotably coupled to the first actuator of the pair and a second end having a first guide pin;

a second arm assembly having a first end pivotably coupled to the second actuator of the pair and a second end having a second guide pin;

a first latching member coupled to the second end of the first arm assembly and a second latching member coupled to the second end of the second arm assembly, the first and second latching members each having an engagement portion for engagement with the keeper; and a pair of slotted tracks formed within the housing in operative association with the first and second latching members, the pair of slotted tracks comprising a first slot and a second slot within at least one sidewall forming the housing, the first and second slots having a non-latching end and a latching end, wherein the second end of the first arm assembly is coupled to the first slot by the first guide pin and the second end of the second arm assembly is coupled to the second slot by the second guide pin;

wherein rotation of one of the actuators causes the first and second latching members to be rotated while being displaced along the first and second slots towards one of the first and second housing ends between a non-latching position and a latching position for engagement with the keeper while the first and second guide pins are displaced along the first and second slots between the non-latching ends and latching ends thereof.

2. The lock assembly of claim 1, wherein the first and second latching members have a first end threadingly coupled to the second end of one of the first and second arm assemblies.

3. The lock assembly of claim 2, wherein the engagement portion of the first and second latching members each comprise an enlarged second end adapted to engage the keeper when arranged in the latching position, wherein rotation of the first and second latching members displaces the enlarged second ends relative to the first and second arm assemblies for alignment with the keeper.

4. The lock assembly of claim 1, wherein the first slot and the second slot each include a first portion extending longitudinally within the sidewall along a longitudinal axis of the housing and a second portion in communication with the first portion extending within the sidewall at an obtuse angle to the first portion.

5. The lock assembly of claim 1, further including a spring in engagement with the first and second arm assemblies for biasing the first and second latching members in the non-latching and latching positions.

6. The lock assembly of claim 1, further including a plunger assembly in operative association with the first arm assembly for maintaining the first and second latching members in the non-latching position, wherein the plunger assembly is operative to release the first and second latching members from the non-latching position.

7. The lock assembly of claim 6, wherein the plunger assembly includes a spring biased body in releasable engagement with a notch in the first arm assembly.

8. A multi-point lock assembly adapted for releasable engagement with a keeper, the lock assembly comprising:

a housing having first and second spaced apart housing ends, the housing including a pair of spaced apart sidewalls at least one including first and second tracks formed by an elongated opening, wherein the first and second tracks each include a first portion having a non-latching end and a second portion having a latching end;

first and second meshed actuators rotatably supported within the housing between the first and second spaced apart ends, whereby rotation of the first actuator causes rotation of the second actuator;

a first arm assembly having a first end pivotally coupled to the first actuator and a second end having a first guide pin in operative association with the first track;

a second arm assembly having a first end pivotally coupled to the second actuator and a second end having a second guide pin in operative association with the second track;

a first latching member coupled to the first arm assembly having a first portion adapted for releasable engagement with a keeper, the first latching member having a latching position outside of the housing and a non-latching position within the housing;

a second latching member coupled to the second arm assembly having a first portion adapted for releasable engagement with a keeper, the second latching member having a latching position outside of the housing and a non-latching position within the housing; and wherein rotation of the first or second actuator causes rotation and longitudinal displacement of the first and second latching members along the first and second portions of the first and second tracks between the non-latching ends and the latching ends thereof and between the non-latching and the latching positions, whereby the first and second portions of the latching members engage the keeper when in the latching position.

9. The lock assembly of claim 8, wherein the first and second actuators include meshed gears, whereby rotation of one actuator in one direction causes rotation of the other actuator in the opposite direction.

10. The lock assembly of claim 8, wherein the first and second latching members have a first end threadingly coupled to the first and second arm assemblies.

11. The lock assembly of claim 10, wherein the first and second latching members each have an enlarged second end adapted to engage a keeper when arranged in the latching position, wherein rotation of the first and second latching members displaces the enlarged second ends relative to the first and second arm assemblies for alignment with the keeper.

12. The lock assembly of claim 8, wherein the first and second tracks each include a first and second linear portion arranged at an obtuse angle.

13. The lock assembly of claim 8, further including a plunger assembly in operative association with the first arm assembly for maintaining the first and second latching members in the non-latching position, wherein the plunger assembly is operative to release the first and second latching members from the non-latching position.

14. A multi-point door lock assembly for releasable engagement with a keeper, the lock assembly comprising:

an elongated hollow housing having spaced apart sidewalls and first and second spaced apart ends;

first and second meshed actuators rotatably supported within the housing, wherein rotation of at least one of the first and second actuators in one direction causes rotation of the other actuator in an opposite direction;

a first arm assembly having a first end and a second end, the first end of the first arm assembly pivotably coupled to the first actuator;

a second arm assembly having a first end and a second end, the first end of the second arm assembly pivotably coupled to the second actuator;

a first bolt having an enlarged end and an opposite threaded end threadingly coupled to the second end of the first arm assembly;

a second bolt having an enlarged end and an opposite threaded end threadingly coupled to the second end of the second arm assembly;

a first slotted track formed within at least one of the sidewalls of the housing having a first portion including a non-latching end and a second portion including a latching end, the first track coupled to the second end of the first arm assembly by a first guide pin attached to the second end of the first arm assembly, the first guide pin having a portion thereof captured within the first track for movement along the first and second portions thereof;

a second slotted track formed within at least one of the sidewalls of the housing having a first portion including a non-latching end and a second portion including a latching end, the second track coupled to the second end of the second arm assembly by a second guide pin attached to the second end of the second arm assembly, the second guide pin having a portion thereof captured within the second track for movement along the first and second portions thereof;

whereby rotation of at least one of the first or second actuators causes the second ends of the first and second arm assemblies to be guided within the housing along the first and second tracks between the non-latching ends and the latching ends thereof by the first and second guide pins received therein, wherein the first and second bolts are rotated while being displaced in a direction along the first and second portions of the first and second tracks between a non-latching position within the housing when the first and second guide pins are located at the non-latching ends of the first and second tracks and a latching position outside of the housing when the first and second guide pins are located at the latching ends of the first and second tracks, whereby the enlarged end of the first and second bolts are adapted for releasably engaging a keeper.

15. The lock assembly of claim 14, wherein the first and second slotted tracks each include first and second linear portions arranged at an obtuse angle.

16. The lock assembly of claim 14, further including a spring in engagement with the first and second arm assemblies for biasing the first and second latching members in the non-latching and latching positions.

17. The lock assembly of claim 14, further including a plunger assembly in operative association with the first arm assembly for maintaining the first and second latching members in the non-latching position, wherein the plunger assembly is operative to release the first and second latching members from the non-latching position, and wherein the plunger assembly includes a spring biased body in releasable engagement with a notch in the first arm assembly.

18. A multi-point lock assembly adapted for releasable engagement with a keeper, the lock assembly comprising;

a housing having first and second tracks each formed from an opening having a non-latching end and a latching end;

a pair of spaced apart latching members each including an engagement portion and moveable between a non-latching position within the housing and a latching position in releasable engagement with a keeper;

an actuator assembly operative for rotating and displacing the latching members between the non-latching and latching positions;

a pair of arm assemblies having a first end coupled to the actuator assembly and a second end respectively attached to the latching members, the second end of each arm assembly including a guide pin received with one of the first and second tracks for guiding the latching members between non-latching and latching positions for engagement of the engagement portion with the keeper; and wherein the latching members upon operation of the actuator assembly are rotated while displaced in a direction along the first and second tracks between the non-latching position with the guide pin of each arm assembly arranged at the non-latching end and a latching position with the guide pin of each arm assembly arranged at the latching end.

19. The lock assembly of claim 18, wherein the latching members comprise threaded bolts.

20. The lock assembly of claim 19, wherein the engagement portion comprises an enlarged head for releasable engagement with the keeper.

21. The lock assembly of claim 18, wherein the first track comprises a first pair of slots at one end of the housing and the second track comprises a second pair of slots at the other end of the housing.

22. The lock assembly of claim 21, wherein each slot includes a first linear portion arranged at an obtuse angle to a second linear portion.

23. The lock assembly of claim 18, wherein the arm assemblies having a longitudinal axis, and wherein the latching members are moveable in a transverse direction to the longitudinal axis of the arm assemblies.

24. A multi-point lock assembly for releasable engagement with a keeper comprising:

a housing having spaced apart sidewalls;

a first latching member attached to a first arm assembly coupled to an actuator assembly;

a second latching member attached to a second arm assembly coupled to an actuator assembly, the first and second arm assemblies each having a guide pin, and the first and second latching members each having an engagement portion for engagement with the keeper; and an actuator assembly supported within the housing operative for rotating and displacing the first and second latching members between a non-latching position and a latching position;

at least one slotted track formed within the sidewalls of the housing in operative association with at least one of the first and second arm assemblies by capturing therein one of the guide pins associated therewith, the at least one slotted track including a first portion having a non-latching end and a second portion having a latching end, wherein operation of the actuator assembly causes at least one of the guide pins to be displaced along the first and second portions of the at least one slotted track between the non-latching end and the latching end, whereby the engagement portion of the first and second latching members are reversibly rotated and displaced in a direction along the at least one slotted track from a non-latching position within the housing to a latching position outside the housing for engagement with the keeper.

25. The lock assembly of claim 24, wherein the actuator assembly comprises a pair of meshed actuators rotationally arranged within the housing, a first arm assembly coupled to one of the actuators and a second arm assembly coupled to the other actuator.

26. The lock assembly of claim 24, wherein the first and second latching members comprise elongated members having an enlarged end comprising the engagement portion and a threaded end coupled to the actuator assembly.

27. The lock assembly of claim 24, wherein the first and second slotted tracks comprises a slot having first and second linear portions arranged at an obtuse angle.

* * * * *